US009658549B2

(12) United States Patent
Tanaka et al.

(10) Patent No.: US 9,658,549 B2
(45) Date of Patent: May 23, 2017

(54) TONER

(71) Applicant: CANON KABUSHIKI KAISHA, Tokyo (JP)

(72) Inventors: Masatake Tanaka, Yokohama (JP); Yoshihiro Nakagawa, Numazu (JP); Naoya Isono, Suntou-gun (JP); Harumi Takada, Susono (JP); Yuichi Yajima, Susono (JP); Dai Nozaki, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/154,802

(22) Filed: May 13, 2016

(65) Prior Publication Data

US 2016/0349640 A1 Dec. 1, 2016

(30) Foreign Application Priority Data

May 28, 2015 (JP) ..... 2015-108566

(51) Int. Cl.
*G03G 9/087* (2006.01)

(52) U.S. Cl.
CPC ..... *G03G 9/08728* (2013.01)

(58) Field of Classification Search
CPC ..... G03G 9/08786; G03G 9/08788; G03G 9/08755; G03G 9/08704
See application file for complete search history.

(56) References Cited

U.S. PATENT DOCUMENTS

| | | | |
|---|---|---|---|
| 6,569,589 | B2 | 5/2003 | Inaba et al. |
| 7,833,685 | B2 | 11/2010 | Tanaka et al. |
| 7,943,281 | B2 | 5/2011 | Kaya et al. |
| 8,367,289 | B2 | 2/2013 | Isono et al. |
| 8,377,616 | B2 | 2/2013 | Tani et al. |
| 8,440,382 | B2 | 5/2013 | Isono et al. |
| 8,497,054 | B2 | 7/2013 | Sugiyama et al. |
| 8,603,712 | B2 | 12/2013 | Aoki et al. |
| 8,628,899 | B2 | 1/2014 | Kawamura et al. |
| 8,652,737 | B2 | 2/2014 | Handa et al. |
| 8,741,519 | B2 | 6/2014 | Watanabe et al. |
| 8,778,581 | B2 | 7/2014 | Nonaka et al. |
| 8,815,484 | B2 | 8/2014 | Tanaka et al. |
| 8,828,633 | B2 | 9/2014 | Itabashi et al. |
| 8,846,284 | B2 | 9/2014 | Kinumatsu et al. |
| 9,158,216 | B2 | 10/2015 | Shimano et al. |
| 2010/0035171 | A1 | 2/2010 | Watanabe et al. |
| 2012/0045717 | A1 | 2/2012 | Hiroko et al. |
| 2014/0349232 | A1 | 11/2014 | Kinumatsu et al. |
| 2014/0356779 | A1 | 12/2014 | Hasegawa et al. |
| 2015/0099222 | A1 | 4/2015 | Terui et al. |
| 2015/0153666 | A1 | 6/2015 | Isono et al. |
| 2015/0153667 | A1 | 6/2015 | Noji et al. |
| 2015/0153668 | A1 | 6/2015 | Tanaka et al. |
| 2015/0153669 | A1 | 6/2015 | Yoshida et al. |
| 2015/0153670 | A1 | 6/2015 | Shimano et al. |
| 2015/0261110 | A1 | 9/2015 | Nakagawa et al. |
| 2015/0331344 | A1 | 11/2015 | Tominaga et al. |
| 2015/0370189 | A1 | 12/2015 | Tanaka et al. |

FOREIGN PATENT DOCUMENTS

| | | |
|---|---|---|
| JP | S62-273574 | 11/1987 |
| JP | 2000-147832 | 5/2000 |
| JP | 2007-086459 | 4/2007 |
| JP | 2011-053494 | 3/2011 |
| JP | 2015-004869 | 1/2015 |

*Primary Examiner* — Peter Vajda
(74) *Attorney, Agent, or Firm* — Fitzpatrick Cella Harper and Scinto

(57) ABSTRACT

A toner having a toner particle including a binder resin, wherein the binder resin includes a styrene acrylic resin and a vinyl-modified crystalline polyester resin, the vinyl-modified crystalline polyester resin has a crystalline polyester segment having structures of following i) or a structure of following ii), i) at least two structures selected from the group consisting of a structure derived from an aliphatic dicarboxylic acid, a structure derived from an aliphatic diol and a structure derived from an aliphatic hydroxycarboxylic acid;

ii) a structure derived from an aliphatic hydroxycarboxylic acid; and the vinyl-modified crystalline polyester resin has a specific modification rate.

8 Claims, No Drawings

TONER

BACKGROUND OF THE INVENTION

Field of the Invention

The present invention relates to a toner used for image forming methods such as electrophotography, an electrostatic recording method and a toner jet method.

Description of the Related Art

In recent years, energy-saving printers and copiers have been required, which leads to fixing of toners at lower temperatures to achieve energy-saving toners. A variety of approaches using materials for toners have been made to realize such fixing of toners at low temperatures (fixing at low temperature). One of those approaches is a technique of providing a toner containing a crystalline material. This technique is an effective way for achieving a toner allowing fixing at low temperature.

As examples of such a crystalline material, Japanese Patent Application Laid-Open No. S62-273574 and Japanese Patent Application Laid-Open No. 2011-53494 describe composite resins, for example, a block polymer or a graft polymer composed of a crystalline polyester chemically bonded to a non-crystalline vinyl polymer.

SUMMARY OF THE INVENTION

Unfortunately, the present inventors, who have conducted research, have found that the toners containing the crystalline materials described in Japanese Patent Application Laid-Open No. S62-273574 and Japanese Patent Application Laid-Open No. 2011-53494 tend to significantly enhance low-temperature fixing properties but reduce heat-resistant storage properties and durability. For this reason, with a further enhancement in performance of printers and copiers, the heat-resistant storage properties and the durability of the toner need to be further modified or improved as well as the low-temperature fixing properties of the toner.

The present invention is directed to providing a toner having compatibility between low-temperature fixing properties, heat-resistant storage properties and durability at higher levels.

The present inventors, who have conducted extensive research in order to achieve the object, have found that compatibility between low-temperature fixing properties, heat-resistant storage properties and durability at higher levels is attained by a toner having a toner particle including a styrene acrylic resin and a specific vinyl-modified crystalline polyester resin, and have achieved the present invention.

According to one aspect of the present invention, there is provided a toner having a toner particle including a binder resin, wherein, the binder resin includes a styrene acrylic resin and a vinyl-modified crystalline polyester resin, the vinyl-modified crystalline polyester resin has a crystalline polyester segment having structures of following i) or a structure of following ii), i) at least two structures selected from the group consisting of a structure derived from an aliphatic dicarboxylic acid, a structure derived from an aliphatic diol and a structure derived from an aliphatic hydroxycarboxylic acid;

ii) a structure derived from an aliphatic hydroxycarboxylic acid; and wherein, when a modification rate (mass %) of the vinyl-modified crystalline polyester resin having a molecular weight of at least $1\times10^{3.5}$ and less than $1\times10^{\{3.5+(A90-3.5)/4\}}$ is defined as $X_1$; a modification rate (mass %) of the vinyl-modified crystalline polyester resin having a molecular weight of at least $1\times10^{\{3.5+(A90-3.5)/4\}}$ and less than $1\times10^{\{3.5+(A90-3.5)\times2/4\}}$ is defined as $X_2$; a modification rate (mass %) of the vinyl-modified crystalline polyester resin having a molecular weight of at least $1\times10^{\{3.5+(A90-3.5)\times2/4\}}$ and less than $1\times10^{\{3.5+(A90-3.5)\times3/4\}}$ is defined as $X_3$; and; a modification rate (mass %) of the vinyl-modified crystalline polyester resin having a molecular weight of at least $1\times10^{\{3.5+(A90-3.5)\times3/4\}}$ and $1\times10^{(A90)}$ or less is defined as $X_4$; where, $1\times10^{(A90)}$ represents a molecular weight at an integrated value 90% of the integral molecular weight distribution curve, $X_1$, X2, X3 and X4 satisfies the following formula (1):

$$X_1<X_2<X_3<X_4 \quad (1).$$

Further features of the present invention will become apparent from the following description of exemplary embodiments.

DESCRIPTION OF THE EMBODIMENTS

Preferred embodiments of the present invention will now be described in detail.

The toner of the present invention has a toner particle including a binder resin having a styrene acrylic resin and a vinyl-modified crystalline polyester resin. The vinyl-modified crystalline polyester resin has a crystalline polyester segment having structures of following i) or a structure of following ii):

i) at least two structures selected from the group consisting of a structure derived from an aliphatic dicarboxylic acid, a structure derived from an aliphatic diol and a structure derived from an aliphatic hydroxycarboxylic acid;

ii) a structure derived from an aliphatic hydroxycarboxylic acid. Furthermore, the vinyl-modified crystalline polyester resin is a modified crystalline polyester resin modified with a vinyl polymer segment. A modification rate of the vinyl-modified crystalline polyester resin satisfies the following formula (1):

$$X_1<X_2<X_3<X_4 \quad (1)$$

wherein in the formula (1), $X_1$ represents a modification rate (mass %) of the vinyl-modified crystalline polyester resin having a molecular weight of at least $10^{3.5}$ and less than $10^{\{3.5+(A90-3.5)/4\}}$;

$X_2$ represents a modification rate (mass %) of the vinyl-modified crystalline polyester resin having a molecular weight of at least $10^{\{3.5+(A90-3.5)/4\}}$ and less than $10^{\{3.5+(A90-3.5)\times2/4\}}$;

$X_3$ represents a modification rate (mass %) of the vinyl-modified crystalline polyester resin having a molecular weight of at least $10^{\{3.5+(A90-3.5)\times2/4\}}$ and less than $10^{\{3.5+(A90-3.5)\times3/4\}}$;

$X_4$ represents a modification rate (mass %) of the vinyl-modified crystalline polyester resin having a molecular weight of at least $10^{\{3.5+(A90-3.5)\times3/4\}}$ and $10^{(A90)}$ or less; and $1\times10^{(A90)}$ represents a molecular weight at an integrated value 90% of the integral molecular weight distribution curve.

The modification rate of the vinyl-modified crystalline polyester resin indicates a mass ratio of the vinyl polymer segment in the vinyl-modified crystalline polyester resin in each fraction of $X_1$ to $X_4$.

As a general tendency, a crystalline polyester resin having a smaller molecular weight more significantly enhances low-temperature fixing properties and more significantly reduces heat-resistant storage properties and durability, whereas a crystalline polyester resin having a larger molecular weight barely enhances low-temperature fixing properties and barely reduces heat-resistant storage properties and durability. Accordingly, it is believed that a low-molecular weight component significantly affects an enhancement in low-temperature fixing properties and a reduction in heat-resistant storage properties and durability in the toner containing a conventional crystalline polyester resin.

In contrast, in the toner of the present invention, a styrene acrylic resin and a specific vinyl-modified crystalline polyester resin contained in the toner prevent a reduction in heat-resistant storage properties and durability while maintaining the effect of enhancing low-temperature fixing properties.

The present inventors infer the following mechanism. $X_1$ represents the modification rate (proportion of the vinyl polymer in the crystalline polyester) of a vinyl-modified crystalline polyester resin which particularly significantly enhances low-temperature fixing properties and particularly significantly reduces heat-resistant storage properties and durability. $X_2$ represents the modification rate of a vinyl-modified crystalline polyester resin which relatively significantly enhances low-temperature fixing properties and relatively significantly reduces heat-resistant storage properties and durability. $X_3$ represents the modification rate of a vinyl-modified crystalline polyester resin which barely enhances low-temperature fixing properties and relatively barely reduces heat-resistant storage properties and durability. $X_4$ represents the modification rate of a vinyl-modified crystalline polyester resin which hardly enhances low-temperature fixing properties and hardly reduces heat-resistant storage properties and durability.

Here, it is believed that in formation of the domain of the vinyl-modified crystalline polyester resin in the styrene acrylic resin, molecules having a higher modification rate have higher affinity with the styrene acrylic resin to more readily reside at the interface between the styrene acrylic resin and the crystalline polyester resin. At this time, it is believed that a vinyl-modified crystalline polyester resin component more significantly reducing heat-resistant storage properties and durability is more readily wrapped inside of the domain by $X_1$ to $X_4$ satisfying the above formula (1). Conversely, it is believed that a vinyl-modified crystalline polyester resin component hardly reducing heat-resistant storage properties and durability more readily resides at the interface between the domain of the crystalline polyester resin and the styrene acrylic resin. As a result, it is believed that a reduction in heat-resistant storage properties and durability is prevented.

The configuration of the toner of the present invention will be sequentially described.

(Vinyl-Modified Crystalline Polyester Resin)

The vinyl-modified crystalline polyester resin according to the present invention will be described.

The crystalline polyester segment of the vinyl-modified crystalline polyester resin according to the present invention has structures of following i) or a structure of following ii): i) at least two structures selected from the group consisting of a structure derived from an aliphatic dicarboxylic acid, a structure derived from an aliphatic diol and a structure derived from an aliphatic hydroxycarboxylic acid; or ii) a structure derived from an aliphatic hydroxycarboxylic acid. The crystalline polyester segment more preferably has the structure i).

In the present invention, the term "crystalline" of the crystalline polyester resin indicates that a polyester resin has a clear endothermic peak (melting point) in differential scanning calorimetry (DSC) described later. No clear endothermic peak found in a resin indicates that the resin is amorphous.

Examples of the aliphatic dicarboxylic acid include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,15-pentadecanedicarboxylic acid, 1,16-hexadecanedicarboxylic acid, 1,17-heptadecanedicarboxylic acid, 1,18-octadecanedicarboxylic acid, 1,19-nonadecanedicarboxylic acid, 1,20-icosanedicarboxylic acid, 1,21-heneicosanedicarboxylic acid and 1,22-docosanedicarboxylic acid. These may be mixed in use. These may be used in the reaction in the form of a compound composed of a carboxyl group converted into an acid anhydride or an alkyl ester (preferably 1 to 4 carbon atoms).

Examples of the aliphatic diol include ethylene glycol, propylene glycol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,15-pentadecanediol, 1,16-hexadecanediol, 1,17-heptadecanediol, 1,18-octadecanediol, 1,19-nonadecanediol, 1,20-icosanediol, 1,21-heneicosanediol and 1,22-docosanediol. These may be mixed in use.

Examples of the aliphatic hydroxycarboxylic acid include hydroxy acetic acid, 3-hydroxypropionic acid, 4-hydroxybutanoic acid, 5-hydroxypentanoic acid, 6-hydroxyhexanoic acid, 7-hydroxyheptanoic acid, 8-hydroxyoctanoic acid, 9-hydroxynonanoic acid, 10-hydroxydecanoic acid, 11-hydroxyundecanoic acid, 12-hydroxydodecanoic acid, 13-hydroxytridecanoic acid, 14-hydroxytetradecanoic acid, 15-hydroxypentadecanoic acid, 16-hydroxyhexadecanoic acid, 17-hydroxyheptadecanoic acid, 18-hydroxyoctadecanoic acid, 19-hydroxynonadecanoic acid, 20-hydroxyicosanoic acid, 21-hydroxyheneicosanoic acid, 22-hydroxydocosanoic acid and 23-hydroxytricosanoic acid. These may be mixed in use. These may be used in the reaction in the form of a compound having a hydroxy group and a carboxyl group converted into lactone or a compound having a carboxyl group converted into an alkyl ester (preferably 1 to 4 carbon atoms).

The composition of the vinyl polymer segment in the vinyl-modified crystalline polyester resin can contain a known vinyl monomer such as styrene, methyl acrylate, methyl methacrylate, n-butyl acrylate or n-butyl methacrylate. These may be mixed in use. Styrene is particularly preferred. Styrene effectively works as a compatibilized segment with the styrene acrylic resin to provide a greater plasticity during melting.

Examples of the form of the vinyl-modified crystalline polyester resin as a polymer include graft polymers and block polymers. Block polymers having a crystalline polyester segment and a vinyl polymer segment are preferred because an enhancement in crystallinity leads to an enhancement in heat resistance.

The mass ratio (modification rate) of the vinyl polymer segment in the vinyl-modified crystalline polyester resin is preferably within the range of 10 mass % or more and 60 mass % or less. A modification rate of 60 mass % or less provides excellent sharp melt properties and superior low-temperature fixing properties. A modification rate of 10 mass % or more enhances the affinity with the styrene acrylic resin to provide an excellent effect of low-temperature fixing properties. A modification rate within this range also provides superior effects of heat-resistant storage properties and durability. The mass ratio (modification rate) of the vinyl polymer segment in the vinyl-modified crystalline polyester resin is more preferably within the range of 20 mass % or more and 50 mass % or less.

The weight average molecular weight (Mw) of the vinyl polymer segment in the vinyl-modified crystalline polyester resin is preferably within the range of 3000 or more and 20000 or less. A vinyl polymer segment having a weight average molecular weight of 3000 or more exerts an effect as a beginning point of compatibilizing more readily to provide a superior effect of low-temperature fixing properties. A vinyl polymer segment having a weight average molecular weight of 3000 or more tends to also provide good heat resistance and durability. A vinyl polymer segment having a weight average molecular weight of 20000 or less maintains the sharp melt properties of the vinyl-modified crystalline polyester resin more readily to provide a superior effect of low-temperature fixing properties. The weight average molecular weight is more preferably within the range of 4000 or more and 15000 or less. The weight average molecular weight (Mw) of the vinyl polymer segment can be controlled within this range through the amount of the polymerization initiator, the timing of addition, the reaction temperature and the like.

The weight average molecular weight (Mw) of vinyl-modified crystalline polyester resin is preferably within the range of 10000 or more and 100000 or less. A vinyl-modified crystalline polyester resin having a weight average molecular weight of 10000 or more tends to provide excellent mechanical strength of the vinyl-modified crystalline polyester resin and thus better durability. A vinyl-modified crystalline polyester resin having a weight average molecular weight of 100000 or less provides a plastic effect more readily and thus a superior effect of low-temperature fixing properties. The weight average molecular weight of the vinyl-modified crystalline polyester resin is more preferably within the range of 15000 or more and 50000 or less. The weight average molecular weight (Mw) of the vinyl-modified crystalline polyester resin can be controlled within this range through the molar ratio of acid and alcohol which form an ester bond, the timing of adding raw materials, the reaction temperature, the reaction time and the like.

The melting point of the vinyl-modified crystalline polyester resin is preferably within the range of 55° C. or more and 85° C. or less. A melting point of 55° C. or more provides excellent heat resistance. A melting point of 85° C. or less tends to provide good low-temperature fixing properties. The melting point is more preferably within the range of 60° C. or more and 80° C. or less. The melting point of the vinyl-modified crystalline polyester resin can be controlled within this range through the monomer forming the crystalline polyester segment, the weight average molecular weight (Mw) of the vinyl-modified crystalline polyester resin, the modification rate and the like.

The content of the vinyl-modified crystalline polyester resin is preferably within the range of 1 mass % or more and 35 mass % or less of the binder resin. A content of the vinyl-modified crystalline polyester resin in the binder resin of 1 mass % or more readily provides the effect of low-temperature fixing properties. A content of the vinyl-modified crystalline polyester resin in the binder resin of 35 mass % or less tends to provide good heat resistance and durability. The content is more preferably 5 mass % or more and 20 mass % or less.

Examples of the method of producing a vinyl-modified crystalline polyester resin modified with a vinyl polymer segment include the following methods A to C. In the method A, a crystalline polyester segment is preliminarily synthesized, and a vinyl polymer segment is then extended by atom transfer radical polymerization, for example. In the method B, a vinyl polymer segment having a reactive functional group introduced thereinto is preliminarily synthesized, and a crystalline polyester segment is then extended. In the method C, a crystalline polyester segment and a vinyl polymer segment are preliminarily separately synthesized and then combined. Among these methods, the method B is preferred to obtain a vinyl-modified crystalline polyester resin of the present invention satisfying formula (1). In the method B, a vinyl-modified crystalline polyester resin is obtained through polymerization of an aliphatic diol and an aliphatic dicarboxylic acid for forming a crystalline polyester segment, and a vinyl polymer segment having a reactive functional group introduced thereinto. The method B is more preferred because the modification rate is likely to be lower in the lower molecular weight components having a larger number of molecules and higher in the higher molecular weight components having a smaller number of molecules than in the method A. The method B is more preferred because high molecular weight components more readily react so that the modification rate is lower in lower molecular weight components and higher in higher molecular weight components than in the method C.

In preparation of the vinyl-modified crystalline polyester resin satisfying formula (1) by the method B, it is further important to make the raw material monomer for the crystalline polyester segment be compatibilized homogeneously with the vinyl polymer segment as early as possible from the start of the reaction. Whether these components are homogeneously compatibilized can be visually determined from the transparency of the reaction system. The homogeneously compatibilized state of these components can be accelerated through the reaction temperature, the timing to add raw materials, use of a solvent and the like.

The vinyl-modified crystalline polyester resin according to the present invention can also be produced from a blend of two or more vinyl-modified crystalline polyester resins.

The block polymer and the graft polymer are defined according to "Glossary of Basic Terms in Polymer Science, International Union of Pure and Applied Chemistry Macromolecular Nomenclature Commission, translated by the Society of Polymer Science, Japan".

(Styrene Acrylic Resin)

The styrene acrylic resin according to the present invention will be described.

Vinyl polymerizable monomers allowing radical polymerization can be used as a polymerizable monomer for a styrene acrylic resin. A monofunctional polymerizable monomer or a polyfunctional polymerizable monomer can be used as the vinyl polymerizable monomer.

Examples of the monofunctional polymerizable monomer include styrene and styrene derivatives like α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxy styrene and p-phenylstyrene; acrylic polymerizable monomers like methyl acrylate, ethyl acrylate, n-propyl acrylate, iso-propyl acrylate, n-butyl acrylate, iso-butyl acrylate, tert-butyl acrylate, n-pentyl acrylate, n-hexyl acrylate, 2-ethylhexyl acrylate, n-octyl acrylate, n-nonyl acrylate, cyclohexyl acrylate, benzyl acrylate, dimethylphosphateethyl acrylate, diethylphosphateethyl acrylate, dibutylphosphateethyl acrylate and 2-benzoyloxyethyl acrylate; and methacrylic polymerizable monomers like methyl methacrylate, ethyl methacrylate, n-propyl methacrylate, iso-propyl methacrylate, n-butyl methacrylate, iso-butyl methacrylate, tert-butyl methacrylate, n-pentyl methacrylate, n-hexyl methacrylate, 2-ethylhexyl methacrylate, n-octyl methacrylate, n-nonyl methacrylate, diethylphosphateethyl methacrylate and dibutylphosphateethyl methacrylate.

Examples of the polyfunctional polymerizable monomer include diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxydiethoxy)phenyl)propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-(methacryloxydiethoxy)phenyl)propane, 2,2'-bis(4-(methacryloxypolyethoxy)phenyl)propane, trimethylolpropane trimethacrylate, tetramethylolmethane tetramethacrylate, divinylbenzene, divinylnaphthalene, and divinylether.

These monofunctional polymerizable monomers are used alone or in combinations of two or more, or a monofunctional polymerizable monomer is used in combination with a polyfunctional polymerizable monomer, or these polyfunctional polymerizable monomers are used alone or in combinations of two or more. Among these polymerizable monomers, it is preferred in view of the developing properties and durability of the toner, styrene or styrene derivatives be used alone or be mixed, and be mixed with an acrylic polymerizable monomer to prepare a styrene acrylic resin.

The content of the styrene acrylic resin in the binder resin is preferably 65 mass % or more and 99 mass % or less, more preferably 80 mass % or more and 95 mass % or less with respect to the binder resin.

The binder resin of the present invention may contain a known resin including an amorphous polyester resin in addition to the styrene acrylic resin and the vinyl-modified crystalline polyester resin.

(Toner, Toner Particle)

The toner particle according to the present invention contains a binder resin. The toner particle according to the present invention may further contain known materials such as a colorant, wax and a charge control agent when necessary. Details of these materials will be described later.

The toner according to the present invention includes a toner particle and may further contain an external additive (details will be described later) and the like when necessary.

(Method of Producing Toner Particle)

In the present invention, the toner particle can be produced by any method. The toner particle of the present invention can be produced not only by the conventional method of producing a toner through pulverization, but also by a variety of chemical methods of producing a toner, such as suspension polymerization, emulsion polymerization, suspension granulation and emulsion agglomeration.

Hereinafter, a method of producing a toner particle through suspension polymerization will be described.

The polymerizable monomer forming the binder resin described above, the vinyl-modified crystalline polyester resin of the present invention, and when necessary, other additives such as a colorant and wax are homogeneously dissolved or dispersed with a dispersing machine such as a homogenizer, a ball mill, a colloid mill or an ultrasonic dispersing machine. A polymerization initiator is dissolved in the mixture to prepare a polymerizable monomer composition. Next, the polymerizable monomer composition is suspended in an aqueous medium containing a dispersion stabilizer and polymerized to produce a toner particle.

The polymerization initiator may be added simultaneously when other additives are added to the polymerizable monomer, or may be added to the aqueous medium immediately before suspension. Alternatively, a polymerization initiator dissolved in a polymerizable monomer or a solvent may be added immediately after granulation and before the start of the polymerization reaction.

In a polymerization method using an aqueous medium like suspension polymerization method, a polar resin can be added to the polymerizable monomer composition. Addition of the polar resin can promote wrapping of the vinyl-modified crystalline polyester resin of the present invention or the wax.

If a polar resin is present in the polymerizable monomer composition suspended in the aqueous medium, by a difference in affinity with water, the polar resin readily transfers at the interface between the aqueous medium and the polymerizable monomer composition, so that the polar resin is lopsided on the surface of the toner particle. As a result, the toner particle has a core-shell structure.

If a polar resin for a shell having a high melting temperature is selected, generation of blocking can be prevented during storage of the toner designed so as to melt the binder resin at lower temperatures for the purpose of fixing at low temperature.

(Polar Resin)

A preferred polar resin is a polyester resin or a carboxyl group-containing styrene resin. If a polyester resin or a carboxyl group-containing styrene resin is used as the polar resin, it can be expected to demonstrate the lubricity of the resin itself in the shell formed of the resin lopsided on the surface of the toner particle.

Resins obtained through condensation polymerization of the acid component monomers and alcohol component monomers listed below can be used as the polyester resin according to the polar resin.

Examples of the acid component monomers include terephthalic acid, isophthalic acid, phthalic acid, fumaric acid, maleic acid, malonic acid, succinic acid, glutaric acid, adipic acid, pimelic acid, suberic acid, azelaic acid, sebacic acid, camphoric acid, cyclohexanedicarboxylic acid and trimellitic acid.

Examples of the alcohol component monomers include alkylene glycols and polyalkylene glycols such as ethylene glycol, diethylene glycol, triethylene glycol, 1,2-propylene glycol, 1,3-propylene glycol, 1,4-butanediol, neopentyl glycol and 1,4-bis(hydroxymethyl)cyclohexane, bisphenol A, hydrogenating bisphenol, ethylene oxide adducts of bisphenol A, propylene oxide adducts of bisphenol A, glycerol, trimethylolpropane and pentaerythritol.

The carboxyl group-containing styrene resin according to the polar resin is preferably styrene-based acrylic acid copolymers, styrene-based methacrylic acid copolymers and styrene-based maleic acid copolymers, particularly preferably styrene-acrylic acid ester-acrylic acid copolymers because the charging amount is readily controlled.

Moreover, the carboxyl group-containing styrene resin more preferably contains a monomer having a primary or secondary hydroxyl group. Examples of the specific polymer composition include styrene-2-hydroxyethyl methacrylate-methacrylic acid-methyl methacrylate copolymers, styrene-n-butyl acrylate-2-hydroxyethyl methacrylate-methacrylic acid-methyl methacrylate copolymers and styrene-α-methylstyrene-2-hydroxyethyl methacrylate-methacrylic acid-methyl methacrylate copolymers. A resin containing a monomer having a primary or secondary hydroxyl group has large polarity to enhance the long-term stability of the toner left.

The content of the polar resin is preferably 1.0 part by mass or more and 20.0 parts by mass or less, more preferably 2.0 parts by mass or more and 10.0 parts by mass or less with respect to 100 parts by mass of the binder resin.

(Wax)

The toner particle according to the present invention can contain a known wax. Specifically, examples of the known wax include petroleum waxes and derivatives thereof such as paraffin wax, microcrystalline wax and petrolatum, montan wax and derivatives thereof, hydrocarbon waxes obtained through a Fischer-Tropsch method and derivatives thereof, polyolefin waxes such as polyethylene and derivatives thereof, natural waxes such as carnauba wax and candelilla wax and derivatives thereof. The derivatives include oxides, block copolymers with vinyl monomers, and graft modified products. Examples thereof include alcohols such as higher aliphatic alcohol; fatty acids such as stearic acid and palmitic acid or acid amides, esters and ketones thereof; hard castor oil and derivatives thereof; plant waxes, and animal waxes. These waxes can be used alone or in combination.

Among these waxes, polyolefins, hydrocarbon waxes obtained through a Fischer-Tropsch method or petroleum waxes are preferred because these tend to enhance developability and transfer properties.

These waxes may contain an antioxidant in the range so as not to affect the charging properties of the toner.

The content of the wax can be 1.0 part by mass or more and 30.0 parts by mass or less with respect to 100 parts by mass of the binder resin.

The melting point of the wax used in the present invention is preferably 30° C. or more and 120° C. or less, more preferably 60° C. or more and 100° C. or less.

A wax having thermal properties as described above (having a melting point within the range above) can easily provide the releasing effect of the toner efficiently to ensure a sufficient fixing region.

(Colorant)

The toner particle according to the present invention can contain a known colorant. Examples of the colorant include the following organic pigments, organic dyes and inorganic pigments.

Examples of cyan colorant include copper phthalocyanine compound and derivatives thereof, anthraquinone compounds and basic dye lake compounds. Specifically, examples thereof include: C.I. Pigment Blues 1, 7, 15, 15:1, 15:2, 15:3, 15:4, 60, 62 and 66.

Examples of magenta colorant include: condensation azo compounds, diketopyrrolopyrrole compounds, anthraquinone, quinacridone compounds, basic dye lake compounds, naphthol compounds, benzimidazolone compounds, thioindigo compounds and perylene compounds. Specifically, examples thereof include: C.I. Pigment Reds 2, 3, 5, 6, 7, 23, 48:2, 48:3, 48:4, 57:1, 81:1, 122, 144, 146, 150, 166, 169, 177, 184, 185, 202, 206, 220, 221 and 254, and C.I. Pigment Violet 19.

Examples of yellow colorant include condensed azo compounds, isoindolinone compounds, anthraquinone compounds, azo metal complexes, methine compounds and allylamide compounds. Specifically, examples thereof include: C.I. Pigment Yellows 12, 13, 14, 15, 17, 62, 74, 83, 93, 94, 95, 97, 109, 110, 111, 120, 127, 128, 129, 147, 151, 154, 155, 168, 174, 175, 176, 180, 181, 185, 191 and 194.

Examples of black colorant include carbon black and a mixed black colorant of the yellow colorant, the magenta colorant and the cyan colorant.

These colorant can be used alone or as a mixture, or can be used in the form of a solid solution. The colorant used in the present invention is selected according to the hue angle, saturation, lightness, lightfastness, OHP transparency and the dispersibility in the toner particle.

The colorant can be used in an amount of 1.0 part by mass or more and 20.0 parts by mass or less with respect to 100 parts by mass of the binder resin.

In preparation of the toner particle through suspension polymerization, a colorant hydrophobized with a substance not inhibiting polymerization can be used in consideration of polymerization inhibiting properties and aqueous phase transferability of the colorant. Examples of a preferred method of hydrophobizing a colorant include a method of preliminarily polymerizing a polymerizable monomer in the presence of a colorant to obtain a colored polymer. The obtained colored polymer can be added to the polymerizable monomer composition.

Carbon black may be hydrophobized in the same manner as in the colorant, or may be treated with a substance reactive with the surface functional group of the carbon black (polyorganosiloxane).

(Charge Control Agent, Charge Control Resin)

The toner particle according to the present invention may contain a charge control agent or a charge control resin.

Any known charge control agent or charge control resin can be used. Particularly, a charge control agent or a charge control resin having a high friction charge speed and stably maintaining a constant frictional charge amount is preferred. Furthermore, in preparation of the toner particle through suspension polymerization, a charge control agent having low polymerization inhibiting properties and having substantially no product soluble in an aqueous medium is particularly preferred.

Some charge control agents or charge control resins control the toner to be negatively charged while other charge control agents or charge control resins control the toner to be positively charged.

Examples of the charge control agent or the charge control resin controlling the toner to be negatively charged include monoazo metal compounds; acetylacetone metal compounds; aromatic oxycarboxylic acid, aromatic dicarboxylic acid, oxycarboxylic acid and dicarboxylic acid metal compounds; aromatic oxycarboxylic acids, aromatic monocarboxylic acids, and aromatic polycarboxylic acids and metal salts thereof; anhydrides and esters; phenol derivatives like bisphenol; urea derivatives; metal-containing salicylic acid compounds; metal-containing naphthoic acid compounds; boron compounds; quaternary ammonium salts; calixarene; and charge control resins.

Examples of the charge control agent or the charge control resin controlling the toner to be positively charged include: guanidine compounds; imidazole compounds; tributylbenzylammonium-1-hydroxy-4-naphthosulfonate, quaternary ammonium salts like tetrabutylammonium tetrafluoroborate and analogs thereof such as onium salts like phosphonium salts, and lake pigments thereof; triphenylmethane dyes and lake pigments thereof (laking agent such as phosphorus tungstate, phosphorus molybdate, phosphorus tungsten molybdate, tannic acid, lauric acid, gallic acid, ferricyanide and ferrocyanide); metal salts of higher fatty acids; and charge control resins.

These charge control agents or charge control resins may be added alone or in combinations of two or more.

Among these charge control agents, metal-containing salicylic acid compounds are preferred, and those having a metal aluminum or zirconium are particularly preferred.

The amount of the charge control agent or the charge control resin to be added is preferably 0.01 parts by mass or more and 20.0 parts by mass or less, more preferably 0.5 parts by mass or more and 10.0 parts by mass or less with respect to 100 parts by mass of the binder resin.

A usable charge control resin is a polymer or a copolymer having a sulfonic acid group, a sulfonate group or a sulfonic acid ester group. The polymer having a sulfonic acid group, a sulfonate group or a sulfonic acid ester group is particularly preferably a polymer containing an acrylamide monomer containing a sulfonic acid group or a methacrylamide monomer containing a sulfonic acid group in a copolymerization proportion of 2 mass % or more, more preferably 5 mass % or more.

The charge control resin can have a glass transition temperature (Tg) of 35° C. or more and 90° C. or less, a peak molecular weight (Mp) of 10,000 or more and 30,000 or less and a weight average molecular weight (Mw) of 25,000 or more and 50,000 or less. Use of such a charge control resin can provide preferred friction charging properties without affecting thermal properties required for the toner particle. Furthermore, since the charge control resin has a sulfonic acid group, for example, the dispersibility of the charge control resin itself in the polymerizable monomer composition or the dispersibility of the colorant or the like can be enhanced to further enhance coloring ability, transparency and friction charging properties.

(Polymerization Initiator)

Examples of the polymerization initiator include organic peroxide initiators and azo polymerization initiators.

Examples of the organic peroxide initiators include benzoyl peroxide, lauroyl peroxide, di-α-cumyl peroxide, 2,5-dimethyl-2,5-bis(benzoylperoxy)hexane, bis(4-t-butylcyclohexyl)peroxydicarbonate, 1,1-bis(t-butylperoxy) cyclododecane, t-butylperoxy maleic acid, bis(t-butylperoxy)isophthalate, methyl ethyl ketone peroxide, tert-butylperoxy-2-ethylhexanoate, diisopropylperoxy carbonate, cumene hydroperoxide, 2,4-dichlorobenzoyl peroxide and tert-butyl-peroxypivalate.

Examples of the azo polymerization initiators include 2,2'-azobis-(2,4-dimethylvaleronitrile), 2,2'-azobisisobutyronitrile, 1, 1'-azobis(cyclohexane-1-carbonitrile), 2,2'-azobis-4-methoxy-2,4-dimethylvaleronitrile, azobismethylbutyronitrile and 2,2'-azobis-(isomethyl butyrate).

Alternatively, redox initiators in combination of an oxidizing substance and a reducing substance can also be used as the polymerization initiator. Examples of the oxidizing substance include hydrogen peroxide, inorganic peroxides of persulfonates (sodium salts, potassium salts and ammonium salts) and oxidizing metal salts of quadrivalent cerium salts. Examples of the reducing substance include reducing metal salts (divalent iron salts, monovalent copper salts and trivalent chromium salts); ammonia; lower amines (amines having about 1 or more and 6 or less carbon atoms, like methylamine and ethylamine); amino compounds like hydroxylamine; reducing sulfur compounds such as sodium thiosulfate, sodium hydrosulfate, sodium hydrogen sulfite, sodium sulfite and sodium formaldehyde sulfoxylate; lower alcohols (1 or more and 6 or less carbon atoms); ascorbic acid or salts thereof; and lower aldehydes (1 or more and 6 or less carbon atoms).

These polymerization initiators are selected by reference to the 10-hour half-life temperature and used alone or as a mixture.

Although the amount of the polymerization initiator to be added is varied according to the target degree of polymerization, the polymerization initiator is usually added in an amount of 0.5 parts by mass or more and 20.0 parts by mass or less with respect to 100 parts by mass of the polymerizable monomer.

A known chain transfer agent and polymerization inhibitor can also be added to control the degree of polymerization.

A variety of crosslinking agents can also be used in polymerization of the polymerizable monomer. Examples of the crosslinking agents include polyfunctional compounds like divinylbenzene, 4,4'-divinylbiphenyl, ethylene glycol diacrylate, ethylene glycol dimethacrylate, diethylene glycol diacrylate, diethylene glycol dimethacrylate, glycidyl acrylate, glycidyl methacrylate, trimethylolpropane triacrylate and trimethylolpropane trimethacrylate.

Known inorganic compound dispersion stabilizers and organic compound dispersion stabilizers can be used as a dispersion stabilizer in preparation of an aqueous medium.

Examples of the inorganic compound dispersion stabilizers include tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica and alumina.

Examples of the organic compound dispersion stabilizers include sodium salts of poly(vinyl alcohol), gelatin, methyl cellulose, methyl hydroxypropyl cellulose, ethyl cellulose and carboxymethyl cellulose, polyacrylic acid and salts thereof; and starch.

The amount of these dispersion stabilizers used can be 0.2 parts by mass or more and 20.0 parts by mass or less with respect to 100 parts by mass of the polymerizable monomer.

In use of an inorganic compound dispersion stabilizer among these dispersion stabilizers, commercially available products may be used as they are; or an inorganic compound may be generated in an aqueous medium to obtain a dispersion stabilizer having a smaller particle diameter. For example, tricalcium phosphate is obtained through mixing of a sodium phosphate aqueous solution with a calcium chloride aqueous solution under high-speed stirring.

(External Additive)

The toner particle may contain an external additive externally added thereto to provide a variety of properties to the toner. Examples of the external additive to enhance the fluidity of the toner include inorganic fine particles like silica fine particles, titanium oxide fine particles and fine particles of composite oxides thereof. Among these inorganic fine particles, silica fine particles and titanium oxide fine particles are preferred.

For example, inorganic fine particles can be externally added and mixed to the toner particle to adhere to the surface of the toner particle to obtain a toner of the present invention. The inorganic fine particles can be externally added by any known method. Examples of the method include a method of mixing the toner particles with inorganic fine particles with a Mitsui Henschel mixer (made by NIPPON COKE & ENGINEERING CO., LTD. (the former Mitsui Miike Chemical Engineering Machinery, Co., Ltd.)).

Examples of the silica fine particles include dry silica or fumed silica generated through vapor-phase oxidation of silicon halide, and wet silica produced from liquid glass. Among these silica fine particles, dry silica having a small amount of a silanol group present on the surface and the inside of the silica fine particle and having a small amount of $Na_2O$ and $SO_3^{2-}$. The dry silica may be a composite fine particle of silica and another metal oxide obtained through a production step using a metal halogen compound like aluminum chloride or titanium chloride in combination with a silicon halogen compound.

The inorganic fine particles having surfaces hydrophobized with a treatment agent can adjust the amount of frictional charge of the toner and can enhance the environment stability and the fluidity under high temperature and high humidity of the toner. For this reason, use of hydrophobized inorganic fine particles is preferred. When the inorganic fine particles externally added to the toner absorb moisture, this tends to reduce the amount of frictional charge and the fluidity of the toner, facilitating a reduction in developability and transferability.

Examples of the treatment agent for hydrophobizing inorganic fine particles include unmodified silicone varnishes, a variety of modified silicone varnishes, unmodified silicone oils, a variety of modified silicone oils, silane compounds, silane coupling agents, and other organic silicon compounds and organic titanium compounds. Among these treatment agents, silicone oils are preferred. These treatment agents may be used alone or in combination.

The total amount of the inorganic fine particles to be added is preferably 1.0 part by mass or more and 5.0 parts by mass or less, more preferably 1.0 part by mass or more and 2.5 parts by mass or less with respect to 100 parts by mass of the toner particle. The external additive can have a particle diameter 1/10 or less of the average particle diameter of the toner particle in view of the durability of the toner.

(Methods of Measuring a Variety of Physical Properties)

Hereinafter, methods of measuring a variety of physical properties according to the present invention will be described.

<Method of Measuring Molecular Weight>

The weight average molecular weights (Mw) of the resins such as the styrene acrylic resin and the vinyl-modified crystalline polyester resin are measured as follows by gel permeation chromatography (GPC).

First, a sample is dissolved in tetrahydrofuran (THF) at room temperature. The obtained solution is filtered through a solvent-resistant membrane filter "MYSHORI Disk" (made by Tosoh Corporation) having a pore diameter of 0.2 μm to obtain a sample solution. The sample solution is adjusted such that the concentration of a component soluble in THF is 0.8 mass %. The weight average molecular weight is measured using this sample solution on the following conditions:

apparatus: high performance GPC apparatus "HLC-8220GPC" [made by Tosoh Corporation]
columns: two LF-604 columns [made by SHOWA DENKO K.K.]
eluent: THF
flow rate: 0.6 ml/min
oven temperature: 40° C.
amount of sample to be injected: 0.020 ml.

Molecular weight calibration curves created using standard polystyrene resins (such as trade names "TSK Standard Polystyrenes F-850, F-450, F-288, F-128, F-80, F-40, F-20, F-10, F-4, F-2, F-1, A-5000, A-2500, A-1000 and A-500", made by Tosoh Corporation) are used in calculation of the molecular weight of the sample.

<Method of Measuring Melting Point>

The melting point (Tm) of the vinyl-modified crystalline polyester resin is measured with a differential scanning calorimeter "Q1000" (made by TA Instruments-Waters LLC) according to ASTM D3418-82.

The detector of the apparatus uses the melting points of indium and zinc to perform temperature correction and uses the heat of fusion of indium to perform correction of the amount of heat.

Specifically, 5 mg of the vinyl-modified crystalline polyester resin is precisely weighed and placed in an aluminum pan. An empty aluminum pan is used as a reference. The measurement is performed in the measurement temperature range between 30° C. or more and 200° C. or less at a temperature raising rate and a temperature falling rate of 10° C./min. In the measurement, the temperature is raised to 200° C. once, subsequently lowered to 30° C., and then again raised. In the second temperature raising process, the largest endothermic peak in the DSC curve in the temperature range of 30° C. or more and 200° C. or less is defined as the melting point (Tm) of the vinyl-modified crystalline polyester resin in the DSC measurement.

<Separation of Vinyl-Modified Crystalline Polyester Resin of the Present Invention and Other Binder Resin Components from Toner>

The vinyl-modified crystalline polyester resin and other binder resin components are separated from the toner by the following method. Separation is performed by the following method, and identification of the structure and identification of physical properties such as the melting point are further performed.

(Separation of Binder Resin and Wax from Toner by Preparative Gel Permeation Chromatography (GPC))

The toner is dissolved in tetrahydrofuran (THF). The solvent is distilled off from the obtained soluble content under reduced pressure to extract a toner component soluble in tetrahydrofuran (THF).

The obtained toner component soluble in tetrahydrofuran (THF) is dissolved in chloroform to prepare a sample solution having a concentration of 25 mg/ml.

3.5 ml of the obtained sample solution is injected into the following apparatus, and a resin component having a molecular weight of 2000 or more is separated on the following conditions:

preparative GPC apparatus: made by Japan Analytical Industry Co., Ltd., preparative HPLC LC-980
preparative columns: JAIGEL 3H, JAIGEL 5H (made by Japan Analytical Industry Co., Ltd.)
eluent: chloroform
flow rate: 3.5 ml/min.

The high molecular weight component derived from the resin is separated, and the solvent is then distilled off under reduced pressure. The high molecular weight component is further dried in a 90° C. atmosphere under reduced pressure for 24 hours. The operation is repeated until about 100 mg of the resin component is obtained.

(Separation of Vinyl-Modified Crystalline Polyester Resin and Other Binder Resin Components)

500 ml of acetone is added to 100 mg of the resin component obtained through the operation above. The resin component is completely dissolved with heating to 70° C., and the resulting solution is then gradually cooled to 25° C. to recrystallize the vinyl-modified crystalline polyester resin. The recrystallized vinyl-modified crystalline polyester resin is vacuum filtered to separate the vinyl-modified crystalline polyester resin from a filtrate.

Then, the separated filtrate is gradually added to 500 ml of methanol to reprecipitate the binder resin components other than the vinyl-modified crystalline polyester resin. Subsequently, the binder resin components other than the vinyl-modified crystalline polyester resin are extracted with a vacuum filter.

The obtained vinyl-modified crystalline polyester resin and other binder resin components are dried under reduced pressure at 40° C. for 24 hours.

<Identification of Structures of Vinyl-Modified Crystalline Polyester Resin and Other Binder Resin Components>

The structures of the vinyl-modified crystalline polyester resin and other binder resin components are identified with a nuclear magnetic resonance spectroscopy ($^1$H-NMR) [400 MHz, $CDCl_3$, room temperature (25° C.)].

measurement apparatus: FT NMR apparatus JNM-EX400 (made by JEOL Ltd.)
measurement frequency: 400 MHz
pulse condition: 5.0 μs
frequency range: 10500 Hz
the number of integrations: 64 times <Separation of Molecular Weight Fractions of Vinyl-Modified Crystalline Polyester Resin and Calculation of Modification Rates $X_1$ to $X_4$ of Separated Components>

The molecular weight fractions of the vinyl-modified crystalline polyester resin were separated by preparative GPC on the following conditions:

preparative GPC apparatus: made by Japan Analytical Industry Co., Ltd., preparative HPLC LC-980
preparative columns: JAIGEL 2.5H, JAIGEL 3H (made by Japan Analytical Industry Co., Ltd.)
eluent: chloroform
flow rate: 3.5 ml/min
sample concentration: 200 mg/3 ml.

The eluent of the separated solution is distilled off under reduced pressure at 40° C., and the solution is then further dried under reduced pressure at 40° C. for 24 hours.

The modification rates (mass %) $X_1$ to $X_4$ of the obtained separated components are calculated from integrated values of the spectrum obtained by nuclear magnetic resonance spectroscopy ($^1$H-NMR) [400 MHz, $CDCl_3$, room temperature (25° C.)].

measurement apparatus: FT NMR apparatus JNM-EX400 (made by JEOL Ltd.)
measurement frequency: 400 MHz
pulse condition: 5.0 μs
frequency range: 10500 Hz
the number of integrations: 64 times <Measurement of Content of Vinyl-Modified Crystalline Polyester Resin in Binder Resin Separated from Toner>

The content of the vinyl-modified crystalline polyester resin is calculated from the integrated value of the spectrum obtained in the measurement of the vinyl-modified crystalline polyester resin and other binder resin components by nuclear magnetic resonance spectroscopy ($^1$H-NMR).

measurement apparatus: FT NMR apparatus JNM-EX400 (made by JEOL Ltd.)
measurement frequency: 400 MHz
pulse condition: 5.0 μs
frequency range: 10500 Hz
the number of integrations: 64 times <Method of Measuring Weight Average Particle Diameter (D4) and Number Average Particle Diameter (D1)>

The weight average particle diameter (D4) and the number average particle diameter (D1) of the toner are calculated as follows. The measurement apparatus used is a precise particle size distribution analyzer "Coulter Counter Multisizer 3" (registered trademark, made by Beckman Coulter, Inc.) provided with an aperture tube of 100 μm and using a micropore electric resistance method. The setting of the measurement conditions and analysis of the measured data are performed with dedicated software "Beckman Coulter Multisizer 3 Version 3.51" (made by Beckman Coulter, Inc.) attached to the analyzer. The measurement is performed at 25000 effective measurement channels.

As an electrolytic aqueous solution used for the measurement, one prepared by dissolving super grade sodium chloride in ion exchange water such that the concentration is 1% by mass, such as "ISOTON II" (made by Beckman Coulter, Inc.), can be used.

Before the measurement and analysis are performed, the dedicated software is set as follows.

In the "Change standard measurement method (SOM)" screen in the dedicated software, the total count number in the control mode is set at 50000 particles, and the number of measurement is set at 1. As the Kd value, a value obtained using a "Standard Particle 10.0 μm" (made by Beckman Coulter, Inc.) is set. The threshold and the noise level are automatically set by pressing the "button for measuring threshold/noise level". The current is set at 1600 μA, the gain is set at 2, and the electrolytic solution is set at ISOTON II. The "flush aperture tube after measurement" is checked.

In the "setting of conversion from pulse to particle diameter" screen in the dedicated software, the bin interval is set at a logarithmic particle diameter, the particle diameter bin is set at 256 particle diameter bins, and the range of the particle diameter is set from 2 μm to 60 μm.

A specific measurement method is as follows.

(1) 200 ml of the electrolytic aqueous solution is placed in a 250 ml glass round-bottomed beaker dedicated to Multisizer 3. The beaker is set on a sample stand, and the electrolytic aqueous solution is stirred counterclockwise by a stirrer at 24 turns/sec. By the function of "flush aperture" in the dedicated software, dirt and air bubbles within the aperture tube are removed.

(2) 30 ml of the electrolytic aqueous solution is placed in a 100 ml glass flat-bottomed beaker. 0.3 ml of a diluted solution is put into the flat-bottomed beaker, the diluted solution being obtained by diluting a dispersant "CONTAMINON N" (an aqueous solution of 10 mass % neutral detergent for washing a precise measurement apparatus including a nonionic surfactant, an anionic surfactant and an organic builder and having a pH of 7, made by Wako Pure Chemical Industries, Ltd.) 3 times by mass with ion exchange water.

(3) An ultrasonic disperser "Ultrasonic Dispension System Tetra 150" having an electric output of 120 W (made by Nikkaki Bios Co., Ltd.) is provided, the ultrasonic disperser including two built-in oscillators having an oscillating frequency of 50 kHz with the phase of one oscillator being shifted by 180° from the phase of the other oscillator. 3.3 l of ion exchange water is poured into the water bath in the ultrasonic disperser, and 2 ml of CONTAMINON N is added in the water bath.

(4) The beaker in (2) is set in a beaker fixing hole in the ultrasonic disperser, and the ultrasonic disperser is operated. The height of the beaker is adjusted such that resonance of the solution surface of the electrolytic aqueous solution within the beaker is maximized.

(5) In the state where the electrolytic aqueous solution within the beaker in (4) is irradiated with an ultrasonic wave, 10 mg of the toner is added to the electrolytic aqueous solution little by little and dispersed. Then, the ultrasonic dispersion is continued for another 60 seconds. In the ultrasonic dispersion, the temperature of the solution in the water bath is properly adjusted to be 10° C. or more and 40° C. or less.

(6) Using a pipette, the electrolytic aqueous solution in (5) having the toner dispersed is added dropwise into the round-bottomed beaker in (1) set in the sample stand, and the measurement concentration is adjusted to be 5%. Then, the measurement is performed until the number of measured particles reaches 50000.

(7) The measured data is analyzed by the dedicated software attached to the apparatus, and the weight average particle diameter (D4) and the number average particle diameter (D1) are calculated. The weight average particle diameter (D4) is the "average diameter" on the "analysis/volume statistical value (arithmetic average)" screen when graph/% by volume is set by the dedicated software. The number average particle diameter (D1) is the "average diameter" on the "analysis/number statistical value (arithmetic average)" screen when graph/number % is set by the dedicated software.

EXAMPLES

Hereinafter, the present invention will be more specifically described by way of Examples. The present invention will not be limited by Examples below. Parts and % in Examples and Comparative Examples are all based on mass, unless otherwise specified.

<Preparation of Vinyl-Modified Crystalline Polyester Resin 1>

(Preparation Step 1)

50.0 parts of xylene was heated and refluxed at a solution temperature of 140° C. in a reaction container provided with a stirrer, a thermometer, a nitrogen inlet pipe and a depressurizer while the container was being purged with nitrogen. A mixture of 100.0 parts of styrene and 8.0 parts of dimethyl 2,2'-azobis-(isomethylbutyrate) as a polymerization initiator was added dropwise to the above xylene over 3 hours. After completion of the dropwise addition, the solution was stirred for 3 hours. Subsequently, xylene and the residual styrene were distilled off at 160° C. and 1 hPa to obtain an intermediate vinyl polymer (vinyl polymer having a reactive functional group introduced thereinto).

(Preparation Step 2)

Next, 100.0 parts of the intermediate vinyl polymer obtained above, 128.0 parts of xylene as organic solvents, and 88.8 parts of 1,12-dodecanediol, and 0.6 parts of titanium(IV) isopropoxide as an esterification catalyst were added to a reaction container provided with a stirrer, a thermometer, a nitrogen inlet pipe, a dehydration tube and a depressurizer and reacted under a nitrogen atmosphere at 150° C. for 4 hours. Subsequently, 78.9 parts of sebacic acid was added, and the reaction was performed at 150° C. for 3 hours, and further at 180° C. for 4 hours. At this time, the system became transparent within 10 minutes after addition of sebacic acid. Subsequently, the reaction was further performed at 180° C. and 1 hPa until a desired Mw was attained. Vinyl-modified crystalline polyester resin 1 was thereby obtained. The physical properties of the obtained Vinyl-modified crystalline polyester resin 1 are shown in Table 2. It was verified by differential scanning calorimetry (DSC) that Vinyl-modified crystalline polyester resin 1 had a clear endothermic peak (melting point).

<Preparation of Vinyl-Modified Crystalline Polyester Resins 2 to 24>

Vinyl-modified crystalline polyester resins 2 to 24 were obtained in the same manner as in Vinyl-modified crystalline polyester resin 1 except that the raw materials and the amounts thereof to be added were varied as shown in Table 1. The physical properties of the obtained Vinyl-modified crystalline polyester resins 2 to 24 are shown in Table 2. It was verified by differential scanning calorimetry (DSC) that Vinyl-modified crystalline polyester resins 2 to 24 had clear endothermic peaks (melting points).

<Preparation of Vinyl-Modified Crystalline Polyester Resin 25>

40.0 parts of xylene was heated and refluxed at a solution temperature of 140° C. in a reaction container provided with a stirrer, a thermometer, a nitrogen inlet pipe and a depressurizer while the container was being purged with nitrogen. A mixed solution of 36.3 parts of styrene, 2.9 parts of dicumyl peroxide and 2.3 parts of acrylic acid obtained by stirring and mixing was added dropwise to the above xylene over 3 hours. After completion of the dropwise addition, the solution was stirred for 3 hours. Subsequently, 0.6 parts of an esterification catalyst titanium(IV) isopropoxide was added to 91.5 parts of 1,12-dodecanediol to react at 150° C. for 4 hours. Subsequently, 85.0 parts of sebacic acid was added, and the reaction was performed at 150° C. for 3 hours, and further at 180° C. for 4 hours. At this time, the system became transparent within 10 minutes after addition of sebacic acid. Subsequently, the reaction was further performed at 180° C. and 1 hPa until a desired Mw was attained. Vinyl-modified crystalline polyester resin 25 was thereby obtained. The physical properties of the obtained Vinyl-modified crystalline polyester resin 25 are shown in Table 2. It was verified by differential scanning calorimetry (DSC) that Vinyl-modified crystalline polyester resin 25 had a clear endothermic peak (melting point).

<Preparation of Comparative Resin 1>

81.0 parts of 1,6-hexanediol, 126.0 parts of sebacic acid and 0.1 parts of p-toluenesulfonic acid were placed in a reaction container provided with a stirrer, a thermometer, a nitrogen inlet pipe and a depressurizer to react under a nitrogen atmosphere at 180° C. until distillation of water was terminated. Subsequently, the reaction was further performed at 180° C. and 1 hPa until a desired Mw was attained. Intermediate resin A was thereby obtained.

400.0 parts of xylene, 100.0 parts of styrene and 13.0 parts of 4,4'-azobis-4-cyanovaleric acid were placed in another reaction container provided with a stirrer, a thermometer, a nitrogen inlet pipe and a depressurizer to react at 80° C. for 6 hours. Subsequently, the reaction solution was precipitated in methanol for purifying. The solution was filtered, and was dried to obtain intermediate resin product B.

70.0 parts of intermediate resin product A, 30.0 parts of intermediate resin product B, xylene used to prepare a homogeneous solution of the reaction solution, and 0.1 parts of dibutyltin oxide were placed in another reaction container provided with a stirrer, a thermometer, a nitrogen inlet pipe and a depressurizer to react at 180° C. for 3 hours. Subsequently, the reaction was performed at 180° C. and 1 hPa until a desired Mw was attained. Comparative resin 1 was thereby obtained. The physical properties of the obtained Comparative resin 1 are shown in Table 2.

<Preparation of Comparative Resin 2>

82.2 parts of 1,9-nonanediol was placed in a reaction container provided with a stirrer, a thermometer, a nitrogen inlet pipe and a depressurizer and heated to 170° C. A mixed solution of 35.4 parts of styrene, 2.1 parts of dicumyl peroxide and 2.3 parts of acrylic acid obtained by stirring and mixing was added dropwise over 1 hour. While the temperature was kept at 170° C., the reaction was further performed for 1 hour. At this time, the system was cloudy. Subsequently, the temperature was lowered to 140° C., and 97.5 parts of sebacic acid and 0.1 parts of tertiary butyl catechol were added to react at 180° C. until a desired Mw was attained. Comparative resin 2 was thereby obtained. At this time, the system became transparent when 8 hours had passed since sebacic acid was added. The physical properties of the obtained Comparative resin 2 are shown in Table 2.

TABLE 1

| | | Preparation step 2 | | |
|---|---|---|---|---|
| | Preparation step 1 Amount of polymerization initiator to be added (parts by mass) | Amount of Intermediate vinyl polymer product to be added (parts by mass) | Type of monomer (aliphatic diol, aliphatic carboxylic acid) and amount of monomer to be added (parts by mass) | |
| Vinyl-modified crystalline polyester resin 2 | 8.0 | 10.0 | 1,12-Dodecanediol<br>Sebacic acid | 107.5<br>100.5 |
| Vinyl-modified crystalline polyester resin 3 | 8.0 | 19.6 | 1,12-Dodecanediol<br>Sebacic acid | 102.4<br>94.6 |
| Vinyl-modified crystalline polyester resin 4 | 8.0 | 41.1 | 1,12-Dodecanediol<br>Sebacic acid | 93.2<br>79.0 |
| Vinyl-modified crystalline polyester resin 5 | 8.0 | 117.3 | 1,12-Dodecanediol<br>Sebacic acid | 46.3<br>38.2 |
| Vinyl-modified crystalline polyester resin 6 | 8.0 | 125.9 | 1,12-Dodecanediol<br>Sebacic acid | 42.2<br>32.3 |
| Vinyl-modified crystalline polyester resin 7 | 12.0 | 58.8 | 1,12-Dodecanediol<br>Sebacic acid | 81.3<br>67.3 |
| Vinyl-modified crystalline polyester resin 8 | 13.0 | 56.7 | 1,12-Dodecanediol<br>Sebacic acid | 82.0<br>67.1 |
| Vinyl-modified crystalline polyester resin 9 | 14.0 | 56.7 | 1,12-Dodecanediol<br>Sebacic acid | 82.6<br>62.5 |
| Vinyl-modified crystalline polyester resin 10 | 5.0 | 60.0 | 1,12-Dodecanediol<br>Sebacic acid | 79.1<br>72.7 |
| Vinyl-modified crystalline polyester resin 11 | 4.0 | 60.2 | 1,12-Dodecanediol<br>Sebacic acid | 78.4<br>73.7 |
| Vinyl-modified crystalline polyester resin 12 | 3.8 | 59.9 | 1,12-Dodecanediol<br>Sebacic acid | 79.5<br>73.1 |
| Vinyl-modified crystalline polyester resin 13 | 8.0 | 60.7 | 1,6-Hexanediol<br>Sebacic acid | 60.0<br>97.0 |
| Vinyl-modified crystalline polyester resin 14 | 8.0 | 60.6 | 1,6-Hexanediol<br>Sebacic acid | 59.2<br>97.9 |
| Vinyl-modified crystalline polyester resin 15 | 8.0 | 60.6 | 1,6-Hexanediol<br>Sebacic acid | 59.2<br>97.9 |
| Vinyl-modified crystalline polyester resin 16 | 10.0 | 61.1 | 1,12-Dodecanediol<br>Sebacic acid | 84.5<br>67.9 |
| Vinyl-modified crystalline polyester resin 17 | 10.0 | 60.7 | 1,12-Dodecanediol<br>Sebacic acid | 85.4<br>67.4 |
| Vinyl-modified crystalline polyester resin 18 | 12.0 | 60.8 | 1,12-Dodecanediol<br>Sebacic acid | 87.3<br>65.5 |
| Vinyl-modified crystalline polyester resin 19 | 10.0 | 60.9 | 1,5-Pentanediol<br>Sebacic acid | 59.6<br>98.5 |
| Vinyl-modified crystalline polyester resin 20 | 10.0 | 60.6 | 1,4-Butanediol<br>Sebacic acid | 55.0<br>104.7 |
| Vinyl-modified crystalline polyester resin 21 | 10.0 | 61.0 | 1,12-Dodecanediol<br>1,12-Dodecanedicarboxylic acid | 73.0<br>77.9 |
| Vinyl-modified crystalline polyester resin 22 | 10.0 | 61.2 | 1,6-Hexanediol<br>15-Hydroxypentadecanoic acid | 4.4<br>145.9 |

TABLE 1-continued

| | Preparation step 1 Amount of polymerization initiator to be added (parts by mass) | Preparation step 2 Amount of Intermediate vinyl polymer product to be added (parts by mass) | Preparation step 2 Type of monomer (aliphatic diol, aliphatic carboxylic acid) and amount of monomer to be added (parts by mass) | |
|---|---|---|---|---|
| Vinyl-modified crystalline polyester resin 23 | 10.0 | 59.9 | 1,12-Dodecanediol | 82.8 |
| | | | Sebacic acid | 71.0 |
| Vinyl-modified crystalline polyester resin 24 | 10.0 | 60.2 | 1,6-Hexanediol | 65.1 |
| | | | Sebacic acid | 92.9 |

TABLE 2

| Resin | X1 (%) | X2 (%) | X3 (%) | X4 (%) | Form of polymer | Modification rate (mass %) | Weight average molecular weight (Mw) of vinyl polymer segment | Weight average molecular weight (Mw) | Melting point (° C.) |
|---|---|---|---|---|---|---|---|---|---|
| Vinyl-modified crystalline polyester resin 1 | 30 | 40 | 48 | 52 | Block | 40 | 8000 | 36000 | 76 |
| Vinyl-modified crystalline polyester resin 2 | 3 | 5 | 8 | 11 | Block | 5 | 8000 | 25000 | 80 |
| Vinyl-modified crystalline polyester resin 3 | 7 | 10 | 12 | 15 | Block | 10 | 8000 | 25000 | 80 |
| Vinyl-modified crystalline polyester resin 4 | 7 | 16 | 35 | 42 | Block | 20 | 8000 | 25000 | 77 |
| Vinyl-modified crystalline polyester resin 5 | 50 | 61 | 68 | 75 | Block | 60 | 8000 | 30000 | 73 |
| Vinyl-modified crystalline polyester resin 6 | 53 | 66 | 72 | 79 | Block | 65 | 8000 | 30000 | 73 |
| Vinyl-modified crystalline polyester resin 7 | 17 | 25 | 33 | 41 | Block | 30 | 4000 | 25000 | 75 |
| Vinyl-modified crystalline polyester resin 8 | 16 | 24 | 33 | 42 | Block | 30 | 3000 | 25000 | 75 |
| Vinyl-modified crystalline polyester resin 9 | 16 | 24 | 33 | 42 | Block | 30 | 2000 | 25000 | 74 |
| Vinyl-modified crystalline polyester resin 10 | 13 | 23 | 34 | 43 | Block | 30 | 15000 | 35000 | 75 |
| Vinyl-modified crystalline polyester resin 11 | 12 | 22 | 34 | 44 | Block | 30 | 20000 | 35000 | 75 |
| Vinyl-modified crystalline polyester resin 12 | 12 | 22 | 34 | 46 | Block | 30 | 22000 | 35000 | 75 |
| Vinyl-modified crystalline polyester resin 13 | 17 | 26 | 33 | 41 | Block | 30 | 8000 | 50000 | 60 |
| Vinyl-modified crystalline polyester resin 14 | 11 | 22 | 37 | 46 | Block | 30 | 8000 | 100000 | 60 |
| Vinyl-modified crystalline polyester resin 15 | 13 | 22 | 36 | 46 | Block | 30 | 8000 | 120000 | 60 |
| Vinyl-modified crystalline polyester resin 16 | 18 | 24 | 33 | 39 | Block | 30 | 6000 | 15000 | 78 |
| Vinyl-modified crystalline polyester resin 17 | 18 | 24 | 33 | 39 | Block | 30 | 6000 | 10000 | 77 |

TABLE 2-continued

| Resin | X1 (%) | X2 (%) | X3 (%) | X4 (%) | Form of polymer | Modification rate (mass %) | Weight average molecular weight (Mw) of vinyl polymer segment | Weight average molecular weight (Mw) | Melting point (° C.) |
|---|---|---|---|---|---|---|---|---|---|
| Vinyl-modified crystalline polyester resin 18 | 18 | 24 | 33 | 39 | Block | 30 | 4000 | 8000 | 75 |
| Vinyl-modified crystalline polyester resin 19 | 18 | 26 | 31 | 40 | Block | 30 | 6000 | 25000 | 52 |
| Vinyl-modified crystalline polyester resin 20 | 16 | 24 | 33 | 42 | Block | 30 | 6000 | 25000 | 55 |
| Vinyl-modified crystalline polyester resin 21 | 17 | 24 | 33 | 42 | Block | 30 | 6000 | 25000 | 85 |
| Vinyl-modified crystalline polyester resin 22 | 16 | 24 | 33 | 41 | Block | 30 | 6000 | 25000 | 91 |
| Vinyl-modified crystalline polyester resin 23 | 16 | 24 | 32 | 42 | Block | 30 | 6000 | 25000 | 77 |
| Vinyl-modified crystalline polyester resin 24 | 16 | 24 | 33 | 42 | Block | 30 | 6000 | 20000 | 60 |
| Vinyl-modified crystalline polyester resin 25 | 7 | 16 | 35 | 42 | Graft | 20 | 10000 | 25000 | 75 |
| Comparative resin 1 | 20 | 36 | 29 | 25 | Block | 30 | 10000 | 35000 | 63 |
| Comparative resin 2 | 20 | 28 | 23 | 38 | Graft | 17 | 9000 | 20000 | 64 |

<Preparation of Toner 1>

6.0 parts of tricalcium phosphate was added to 630.0 parts of ion exchange water heated to a temperature of 60° C., and the resulting mixture was stirred with a T.K. homomixer (made by PRIMIX Corporation (the former Tokushu Kika Kogyo Co., Ltd.)) at a stirring rate of 15,000 rpm to prepare an aqueous medium.

The following materials were mixed and stirred with a propeller-type stirrer at a stirring rate of 100 rpm to prepare a mixed solution.

| | |
|---|---|
| styrene | 69.3 parts |
| n-butyl acrylate | 20.7 parts |
| Vinyl-modified crystalline polyester resin 1 | 10.0 parts |

Next, to the mixed solution,

| | |
|---|---|
| cyan colorant (C.I. Pigment Blue 15:3) | 6.5 parts |
| negative charge control agent (BONTRON E-88, made by ORIENT CHEMICAL INDUSTRIES CO., LTD.) | 0.5 parts |
| hydrocarbon wax (melting point = 78° C.) | 9.0 parts |
| negative charge control resin 1 (styrene/2-ethylhexyl acrylate/2-acrylamide-2-methylpropanesulfonic acid copolymer, acid value: 14.5 mgKOH/g, Tg = 83° C., Mw = 33,000) | 0.7 parts |
| polar resin (styrene/2-hydroxyethyl methacrylate/methacrylic acid/methyl methacrylate copolymer, acid value: 10 mgKOH/g, Tg = 80° C., Mw = 15,000) | 5.0 parts |

were added. Subsequently, the mixed solution was heated to a temperature of 65° C. and then stirred with a T.K. homomixer at a stirring rate of 10,000 rpm to be dissolved and dispersed. A polymerizable monomer composition was thereby prepared.

Subsequently, the polymerizable monomer composition was added to the aqueous medium, and as a polymerization initiator,

| | |
|---|---|
| perbutyl PV | 5.4 parts |

(10-hour half-life temperature: 54.6° C., made by NOF CORPORATION (the former Nippon Oil & Fats Co., Ltd.)) was added, and the resulting mixture was stirred with a T.K. homomixer at a temperature of 70° C. and a stirring rate of 15,000 rpm for 20 minutes for granulation.

After stirring and granulation, the mixture was placed in a propeller-type stirrer. While the mixture was further being stirred at a stirring rate of 200 rpm, styrene and n-butyl acrylate as the polymerizable monomers in the polymerizable monomer composition were subjected to polymerization reaction at a temperature of 85° C. for 5 hours to produce a slurry containing a toner particle. After the polymerization reaction was completed, the slurry was cooled. Hydrochloric acid was added to the cooled slurry to adjust the pH to 1.4, and was stirred for 1 hour to dissolve calcium phosphate. Subsequently, the slurry was washed with water in 10 times amount of the slurry. The slurry was filtered, was dried, and was then classified to adjust the particle diameter. A toner particle was thereby obtained.

The toner particle contains 90.0 parts of the styrene acrylic resin, 10.0 parts of Vinyl-modified crystalline polyester resin 1, 6.5 parts of the cyan colorant, 9.0 parts of a wax, 0.5 parts of the negative charge control agent, 0.7 parts of the negative charge control resin 1 and 5.0 parts of the polar resin.

An external additive of hydrophobic silica fine particles (primary particle diameter: 7 nm, BET specific surface area: 130 $m^2/g$) was obtained through hydrophobization of silica fine particles with 20 mass % dimethylsilicone oil, and 1.5 parts of the external additive with respect to 100.0 parts of the toner particle was mixed with a Mitsui Henschel mixer (made by NIPPON COKE & ENGINEERING CO., LTD. (the former Mitsui Miike Chemical Engineering Machinery, Co., Ltd.)) at a stirring rate of 3000 rpm for 15 minutes to obtain Toner 1. Toner 1 had a number average particle diameter D1 of 4.8 μm and a weight average particle diameter D4 of 5.8 μm.

<Preparation of Toners 2 to 27>

Toners 2 to 27 were obtained by the same preparation method as that in Toner 1 except that the raw materials and the amounts (parts) thereof to be added were varied as shown in Table 3. In Toners 2 to 27, it was verified that the ratio of the components in the toner particle was equivalent to that of the raw materials added for preparation of each toner as in Toner 1. The physical properties of Toners 2 to 27 are shown in Table 3.

TABLE 3

| Toner | Binder resin | Parts by mass | Initiator parts by mass | Physical properties of toner D1(μm) | D4(μm) | Mw |
|---|---|---|---|---|---|---|
| Toner 2 | Vinyl-modified crystalline polyester resin 2 | 10.0 | 5.4 | 4.7 | 5.8 | 30000 |
| | Styrene:n-butyl acrylate (77:23) | 90.0 | | | | |
| Toner 3 | Vinyl-modified crystalline polyester resin 3 | 10.0 | 5.4 | 4.8 | 5.8 | 29000 |
| | Styrene:n-butyl acrylate (77:23) | 90.0 | | | | |
| Toner 4 | Vinyl-modified crystalline polyester resin 4 | 10.0 | 5.4 | 4.6 | 5.7 | 30000 |
| | Styrene:n-butyl acrylate (77:23) | 90.0 | | | | |
| Toner 5 | Vinyl-modified crystalline polyester resin 5 | 10.0 | 5.4 | 4.7 | 5.9 | 29000 |
| | Styrene:n-butyl acrylate (77:23) | 90.0 | | | | |
| Toner 6 | Vinyl-modified crystalline polyester resin 6 | 10.0 | 5.4 | 4.5 | 5.7 | 30000 |
| | Styrene:n-butyl acrylate (77:23) | 90.0 | | | | |
| Toner 7 | Vinyl-modified crystalline polyester resin 7 | 10.0 | 5.4 | 4.7 | 5.8 | 29000 |
| | Styrene:n-butyl acrylate (77:23) | 90.0 | | | | |
| Toner 8 | Vinyl-modified crystalline polyester resin 8 | 10.0 | 5.4 | 4.8 | 5.8 | 31000 |
| | Styrene:n-butyl acrylate (77:23) | 90.0 | | | | |
| Toner 9 | Vinyl-modified crystalline polyester resin 9 | 10.0 | 5.4 | 4.3 | 5.7 | 29000 |
| | Styrene:n-butyl acrylate (77:23) | 90.0 | | | | |
| Toner 10 | Vinyl-modified crystalline polyester resin 10 | 10.0 | 5.4 | 4.7 | 5.9 | 29000 |
| | Styrene:n-butyl acrylate (77:23) | 90.0 | | | | |
| Toner 11 | Vinyl-modified crystalline polyester resin 11 | 10.0 | 5.4 | 4.3 | 5.7 | 30000 |
| | Styrene:n-butyl acrylate (77:23) | 90.0 | | | | |
| Toner 12 | Vinyl-modified crystalline polyester resin 12 | 10.0 | 5.4 | 5.0 | 5.7 | 30000 |
| | Styrene:n-butyl acrylate (77:23) | 90.0 | | | | |
| Toner 13 | Vinyl-modified crystalline polyester resin 13 | 10.0 | 5.4 | 4.3 | 5.7 | 29000 |
| | Styrene:n-butyl acrylate (77:23) | 90.0 | | | | |
| Toner 14 | Vinyl-modified crystalline polyester resin 14 | 10.0 | 5.4 | 4.4 | 6.1 | 29000 |
| | Styrene:n-butyl acrylate (77:23) | 90.0 | | | | |
| Toner 15 | Vinyl-modified crystalline polyester resin 15 | 10.0 | 5.4 | 4.3 | 6.1 | 29000 |
| | Styrene:n-butyl acrylate (77:23) | 90.0 | | | | |
| Toner 16 | Vinyl-modified crystalline polyester resin 16 | 10.0 | 5.4 | 4.8 | 5.8 | 29000 |
| | Styrene:n-butyl acrylate (77:23) | 90.0 | | | | |
| Toner 17 | Vinyl-modified crystalline polyester resin 17 | 10.0 | 5.4 | 4.7 | 5.7 | 29000 |
| | Styrene:n-butyl acrylate (77:23) | 90.0 | | | | |
| Toner 18 | Vinyl-modified crystalline polyester resin 18 | 10.0 | 5.4 | 4.3 | 5.8 | 29000 |
| | Styrene:n-butyl acrylate (77:23) | 90.0 | | | | |
| Toner 19 | Vinyl-modified crystalline polyester resin 19 | 10.0 | 5.4 | 4.7 | 5.7 | 30000 |
| | Styrene:n-butyl acrylate (77:23) | 90.0 | | | | |
| Toner 20 | Vinyl-modified crystalline polyester resin 20 | 10.0 | 5.4 | 4.7 | 5.7 | 30000 |
| | Styrene:n-butyl acrylate (77:23) | 90.0 | | | | |
| Toner 21 | Vinyl-modified crystalline polyester resin 21 | 10.0 | 5.4 | 4.7 | 5.7 | 30000 |
| | Styrene:n-butyl acrylate (77:23) | 90.0 | | | | |
| Toner 22 | Vinyl-modified crystalline polyester resin 22 | 10.0 | 5.4 | 4.7 | 5.7 | 30000 |
| | Styrene:n-butyl acrylate (77:23) | 90.0 | | | | |
| Toner 23 | Vinyl-modified crystalline polyester resin 23 | 20.0 | 4.8 | 4.7 | 5.8 | 30000 |
| | Styrene:n-butyl acrylate (77:23) | 80.0 | | | | |
| Toner 24 | Vinyl-modified crystalline polyester resin 23 | 35.0 | 3.9 | 4.5 | 6.0 | 30000 |
| | Styrene:n-butyl acrylate (77:23) | 65.0 | | | | |
| Toner 25 | Vinyl-modified crystalline polyester resin 23 | 40.0 | 3.6 | 4.4 | 6.0 | 30000 |
| | Styrene:n-butyl acrylate (77:23) | 60.0 | | | | |
| Toner 26 | Vinyl-modified crystalline polyester resin 24 | 1.0 | 6.0 | 4.9 | 5.7 | 28000 |
| | Styrene:n-butyl acrylate (77:23) | 99.0 | | | | |
| Toner 27 | Vinyl-modified crystalline polyester resin 25 | 10.0 | 5.4 | 4.7 | 5.7 | 30000 |
| | Styrene:n-butyl acrylate (77:23) | 90.0 | | | | |

<Preparation of Toner 28>

The following materials were preliminarily mixed and melt kneaded with a biaxial extruder. The product was cooled to obtain a kneaded product. The kneaded product was coarsely crushed with a hammer mill. An obtained coarsely crushed product was medium-degree pulverized into a medium-degree pulverized product having a weight average particle diameter of 100 μm through the use of ACM-10 (ACM pulverizer, manufactured by HOSOKAWA MICRON CORPORATION). The obtained medium-degree pulverized product was fine pulverized through the use of a mechanical pulverizer (Turbo Mill model RS Type-250, manufactured by FREUND-TURBO CORPORATION (the former Turbo Kogyo Co., Ltd.). An obtained fine pulverized product was classified to obtain a toner particle.

| | |
|---|---|
| styrene-n-butyl acrylate copolymerization resin (Mw = 30,000, Tg = 55° C.) | 90.0 parts |
| Vinyl-modified crystalline polyester resin 1 | 10.0 parts |
| C.I. Pigment Blue 15:3 | 5.5 parts |
| negative charge control agent [made by ORIENT CHEMICAL INDUSTRIES CO., LTD.: BONTRON E-88] | 3.0 parts |
| hydrocarbon wax (melting point = 78° C.) | 6.0 parts |

An external additive of hydrophobic silica fine particles (primary particle diameter: 7 nm, BET specific surface area: 130 $m^2/g$) was obtained through hydrophobization of silica fine particles with 20.0 mass % dimethylsilicone oil, and 1.5 parts of the external additive with respect to 100.0 parts of the obtained toner particle was mixed with a Mitsui Henschel mixer (made by NIPPON COKE & ENGINEERING CO., LTD.) at a stirring rate of 3000 rpm for 15 minutes to obtain Toner 28. In Toner 28, it was verified that the ratio of the components in the toner particle was equivalent to that of the raw materials added for preparation of Toner 28 as in Toner 1. Toner 28 had D1=4.5 μm and D4=6.0 μm.

<Preparation of Toner 29>

(Preparation of Resin Particle Dispersion Solution 1)

| | |
|---|---|
| styrene | 80.0 parts |
| n-butyl acrylate | 20.0 parts |

were mixed and dissolved, and were dispersed in a solution of 1.5 parts of a nonionic surfactant (made by Sanyo Chemical Industries, Ltd.: Nonipol 400) and 2.2 parts of an anionic surfactant (made by DKS Co., Ltd.: NEOGEN SC) in 120.0 parts of ion exchange water and emulsified. Next, while the dispersed and emulsified product was being slowly mixed for 10 minutes, a solution of 1.5 parts of a polymerization initiator ammonium persulfate in 10.0 parts of ion exchange water was added thereto. After the system was purged with nitrogen, the content was heated to a temperature of 70° C. with stirring, and emulsion polymerization was continued as it was for 4 hours. Resin particle dispersion solution 1 containing dispersed resin particles having an average particle diameter of 0.29 μm was thereby prepared.

(Preparation of Resin Particle Dispersion Solution 2)

| | |
|---|---|
| Vinyl-modified crystalline polyester resin 1 | 100.0 parts |
| methyl ethyl ketone | 300.0 parts |

were dissolved, and were dispersed in a solution of 1.5 parts of a nonionic surfactant (made by Sanyo Chemical Industries, Ltd.: Nonipol 400) and 2.2 parts of an anionic surfactant (made by DKS Co., Ltd.: NEOGEN SC) in 1200.0 parts of ion exchange water and emulsified. Resin particle dispersion solution 2 containing dispersed resin particles having an average particle diameter of 0.30 μm was thereby prepared.

(Preparation of Colorant Particle Dispersion Solution)

| | |
|---|---|
| cyan colorant (C.I. Pigment Blue 15:3) | 20.0 parts |
| anionic surfactant (made by DKS Co., Ltd.: NEOGEN SC) | 3.0 parts |
| ion exchange water | 78.0 parts |

were mixed, and were dispersed with a sand grinder mill to prepare a colorant particle dispersion solution. The particle size distribution of the colorant particle dispersion solution was measured with a particle size analyzer (made by HORIBA, Ltd., LA-700). The average particle diameter of the colorant particle contained in the solution was 0.20 μm. No coarse particle having a particle size of more than 1 μm was observed.

(Preparation of Wax Particle Dispersion Solution)

| | |
|---|---|
| hydrocarbon wax (melting point = 78° C.) | 50.0 parts |
| anionic surfactant (made by DKS Co., Ltd.: NEOGEN SC) | 7.0 parts |
| ion exchange water | 200.0 parts |

were heated to a temperature of 95° C. and dispersed with a homogenizer (made by IKA Works GmbH & Co. KG: ULTRA-TURRAX T50). The product was then dispersed with a pressure ejection homogenizer to prepare a wax particle dispersion solution containing a dispersed wax having an average particle diameter of 0.50 μm.

(Preparation of Charge Control Particle Dispersion Solution)

| | |
|---|---|
| metal compound of di-alkyl-salicylic acid (negative charge control agent, BONTRON E-84, made by ORIENT CHEMICAL INDUSTRIES CO., LTD.) | 5.0 parts |
| anionic surfactant (made by DKS Co., Ltd.: NEOGEN SC) | 3.0 parts |
| ion exchange water | 78.0 parts |

were mixed, and were dispersed with a sand grinder mill to prepare a charge control particle dispersion solution.

(Preparation of Mixed Solution)

| | |
|---|---|
| Resin particle dispersion solution 1 | 210.0 parts |
| Resin particle dispersion solution 2 | 163.0 parts |
| colorant particle dispersion solution | 28.0 parts |
| wax particle dispersion solution | 47.0 parts |

were placed in a reaction container provided with a stirrer, a cooling tube and a thermometer and stirred. The mixed solution was adjusted with 1 mol/L potassium hydroxide to have a pH of 5.2.

120.0 parts of an aqueous solution of 8% sodium chloride as a flocculant was added dropwise to the mixed solution, and the resulting mixture was heated to a temperature of 55° C. with stirring. At this temperature, 10.0 parts of the charge control particle dispersion solution was added. The solution was kept at a temperature of 55° C. for 2 hours and then observed with an optical microscope. It was verified that an aggregated particle having an average particle diameter of 3.2 μm was formed.

Subsequently, 3.0 parts of an anionic surfactant (made by DKS Co., Ltd.: NEOGEN SC) was added to the solution. The solution was then heated to a temperature 95° C. while being continuously stirred, and was kept for 4.5 hours. After cooling, the reaction product was filtered and sufficiently washed with ion exchange water. The reaction product was then fluid-bed dried at a temperature of 45° C. to obtain a toner particle.

The toner particle contained 90.0 parts of the styrene acrylic resin, 10.0 parts of Vinyl-modified crystalline polyester resin 1, 5.5 parts of the cyan colorant, 9.0 parts of the wax and 0.6 parts of the negative charge control particle.

An external additive of hydrophobic silica fine particles (primary particle diameter: 7 nm, BET specific surface area: 130 $m^2/g$) was obtained through hydrophobization of silica fine particles with 20.0 mass % dimethylsilicone oil, and 1.5 parts of the external additive with respect to 100.0 parts of the obtained toner particle was mixed with a Mitsui Henschel mixer (made by NIPPON COKE & ENGINEERING CO., LTD.) at a stirring rate of 3000 rpm for 15 minutes to obtain Toner 29. Toner 29 had D1=4.5 μm and D4=6.3

<Preparation of Toner 30>

| | |
|---|---|
| styrene acrylic binder resin (copolymerized product having styrene:n-butyl acrylate = 80:20 (mass ratio)) (Mw = 30,000, Tg = 55° C.) | 90.0 parts |
| Vinyl-modified crystalline polyester resin 1 | 10.0 parts |
| methyl ethyl ketone | 100.0 parts |
| ethyl acetate | 100.0 parts |
| hydrocarbon wax (melting point = 78° C.) | 9.0 parts |
| cyan colorant (C.I. Pigment Blue 15:3) | 6.5 parts |
| negative charge control resin 1 (styrene/2-ethylhexyl acrylate/2-acrylamide-2-methylpropanesulfonic acid copolymer, acid value: 14.5 mgKOH/g, Tg = 83° C., Mw = 33,000) | 1.0 part |

These materials were dispersed with an Attritor (made by NIPPON COKE & ENGINEERING CO., LTD.) for 3 hours to obtain a colorant dispersion solution.

27.0 parts of calcium phosphate was added to 3000.0 parts of ion exchange water heated to a temperature of 60° C., and the resulting mixture was stirred with a T.K. homomixer (made by PRIMIX Corporation) at a stirring rate of 10,000 rpm to prepare an aqueous medium. The colorant dispersion solution was added to the aqueous medium, and the resulting mixture was stirred with a T.K. homomixer at a temperature of 65° C. under an $N_2$ atmosphere at a stirring rate of 12,000 rpm for 15 minutes to granulate the colorant particle. Subsequently, T.K. homomixer was replaced with a typical propeller stirrer. The stirring rate of the stirrer was kept at 150 rpm. The inner temperature was raised to a temperature of 95° C. and kept for 3 hours to remove the solvent from the dispersion solution. A dispersion solution of a toner particle was prepared.

Hydrochloric acid was added to the obtained dispersion solution of a toner particle to adjust the pH to 1.4, and the dispersion solution was stirred for 1 hour to dissolve calcium phosphate. The dispersion solution was filtered with a pressurized filter, and was washed to obtain a toner aggregate. Subsequently, the toner aggregate was crushed and dried to obtain a toner particle. The toner particle contained 90.0 parts of the styrene acrylic binder resin, 10.0 parts of Vinyl-modified crystalline polyester resin 1, 6.5 parts of the cyan colorant, 9.0 parts of the wax and 1.0 part of the negative charge control resin 1.

An external additive of hydrophobic silica fine particles (primary particle diameter: 7 nm, BET specific surface area: 130 $m^2/g$) was obtained through hydrophobization of silica fine particles with 20 mass % dimethylsilicone oil, and 1.5 parts of the external additive with respect to 100.0 parts of the obtained toner particle was added and mixed with a Mitsui Henschel mixer (made by NIPPON COKE & ENGINEERING CO., LTD.) at a stirring rate of 3000 rpm for 15 minutes to obtain Toner 30. Toner 30 had D1=3.9 μm and D4=6.3 μm.

<Preparation of Comparative Toners 1 and 2>

Comparative toners 1 and 2 were obtained by the same preparation method as in Toner 30 except that Vinyl-modified crystalline polyester resin 1 was replaced by Comparative resin 1 and Comparative resin 2, respectively. In Comparative toners 1 and 2, it was verified that the ratio of the components in the toner particle was equivalent to that of the raw materials added for preparation of each toner as in Toner 1. Comparative toner 1 had D1=3.7 μm and D4=6.4 Comparative toner 2 had D1=3.6 μm and D4=6.3 μm.

<Evaluation of Images>

Evaluation of images was performed with a commercially available color laser printer [HP Color LaserJet 3525dn] partially modified. The laser printer was modified so as to operate only with a process cartridge of one color. The laser printer was also modified such that the temperature of the fixing unit was adjustable at any temperature.

The toner contained in the process cartridge for a black toner attached to the color laser printer was extracted, and the inside of the process cartridge was cleaned with air blow. Each toner (300 g) prepared above was then filled into the process cartridge. The process cartridge refilled with the toner was mounted on the color laser printer to perform the following evaluation of image. The specific image evaluation items are as follows.

[Low-Temperature Fixing Properties]

A solid image (amount of the toner to be applied: 0.9 $mg/cm^2$) was fixed on a transfer material while the fixing temperature was varied and evaluated. The fixing temperature was defined as the surface temperature of the fixing roller measured with a non-contact thermometer. The transfer material used was normal paper of a letter size (paper for XEROX 4200, made by XEROX Corporation, 75 $g/m^2$). In the present invention, it was determined that a solid image ranked as C or higher according to the following criteria for evaluation had the advantageous effect of the present invention.

(Criteria for Evaluation)

A: No offset was generated at 120° C.

B: Offset was generated at 120° C.

C: Offset was generated at 130° C.

D: Offset was generated at 140° C.

[Heat-Resistant Storage Properties (Blocking)]

5 g of each toner was placed in a 50 cc cup made of a resin, and the cup was left at a temperature of 55° C. and a humidity of 10% RH for 3 days. The presence or absence of clots was observed to evaluate the toner. In the present invention, it was determined that a toner ranked as C or higher according to the following criteria for evaluation had the advantageous effect of the present invention.

(Criteria for Evaluation)

A: No clots are generated.

B: Clots are slightly generated, but break with a light touch of a finger.

C: Clots are generated, and do not break with a light touch of a finger.

D: The toner is completely aggregated.

[Durability]

A test was performed under a normal temperature and normal humidity environment (temperature: 23° C., humidity: 60% RH) to print out 35000 sheets of an image having a coverage rate of 1% in horizontal lines. Subsequently, a halftone (the amount of the toner to be applied: 0.6 $mg/cm^2$) image was printed out on a letter size paper XEROX 4200 (made by XEROX Corporation, 75 $g/m^2$) to evaluate durability according to the degree of developing stripes generated. In the present invention, it was determined that a toner ranked as C or higher according to the following criteria for evaluation had the advantageous effect of the present invention.

(Criteria for Evaluation)

A: No developing stripes are generated.

B: One or more and three or less developing stripes are generated.

C: Four or more and six or less developing stripes are generated.

D: Seven or more developing stripes are generated, or developing stripes having a width of 0.5 mm or more are generated.

Examples 1 to 30

In Examples 1 to 30, Toners 1 to 30 were evaluated for the above items. The results of evaluation are shown in Table 4. In Examples 1 to 30 described in Table 4, the numeric value described in the item Durability indicates the number of developing stripes generated.

Comparative Examples 1 and 2

In Comparative Examples 1 and 2, Comparative toners 1 and 2 were evaluated for the above items. The results of evaluation are shown in Table 4. In Comparative Example 1 in Table 4, the numeric value described in the item Durability indicates the number of developing stripes generated (developing stripes having a width of 0.5 mm or more were not generated). In Comparative Example 2 in Table 4, the numeric value described in the item Durability indicates the width of the developing stripe generated.

TABLE 4

| Example | Toner | Low-temperature fixing properties | Heat-resistant storage properties | Durability |
|---|---|---|---|---|
| Example 1 | Toner 1 | A | A | A(0) |
| Example 2 | Toner 2 | C | B | C(6) |
| Example 3 | Toner 3 | B | B | C(4) |
| Example 4 | Toner 4 | A | B | B(2) |
| Example 5 | Toner 5 | B | A | A(0) |
| Example 6 | Toner 6 | C | A | A(0) |
| Example 7 | Toner 7 | A | A | B(1) |
| Example 8 | Toner 8 | B | B | C(4) |
| Example 9 | Toner 9 | B | C | C(5) |
| Example 10 | Toner 10 | A | A | A(0) |
| Example 11 | Toner 11 | B | A | A(0) |
| Example 12 | Toner 12 | C | B | A(0) |
| Example 13 | Toner 13 | B | B | A(0) |
| Example 14 | Toner 14 | C | B | A(0) |
| Example 15 | Toner 15 | C | C | A(0) |
| Example 16 | Toner 16 | A | B | B(1) |
| Example 17 | Toner 17 | A | B | C(4) |
| Example 18 | Toner 18 | A | C | C(6) |
| Example 19 | Toner 19 | A | C | C(6) |
| Example 20 | Toner 20 | A | C | B(3) |
| Example 21 | Toner 21 | B | A | A(0) |
| Example 22 | Toner 22 | C | A | A(0) |
| Example 23 | Toner 23 | A | A | B(1) |
| Example 24 | Toner 24 | A | B | C(4) |
| Example 25 | Toner 25 | A | C | C(4) |
| Example 26 | Toner 26 | C | A | A(0) |
| Example 27 | Toner 27 | A | C | B(2) |
| Example 28 | Toner 28 | A | B | B(1) |
| Example 29 | Toner 29 | A | B | B(1) |
| Example 30 | Toner 30 | A | B | B(1) |
| Comparative Example 1 | Comparative toner 1 | C | D | D(10) |
| Comparative Example 2 | Comparative toner 2 | B | D | D(4 mm) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-108566, filed May 28, 2015, which is hereby incorporated by reference herein in its entirety.

What is claimed is:

1. A toner comprising a toner particle including a binder resin, wherein, the binder resin comprises a styrene acrylic resin and a vinyl-modified crystalline polyester resin, the vinyl-modified crystalline polyester resin has a crystalline polyester segment having structures of following i) or a structure of following ii), i) at least two structures selected from the group consisting of:

a structure derived from an aliphatic dicarboxylic acid, a structure derived from an aliphatic diol and a structure derived from an aliphatic hydroxycarboxylic acid;

ii) a structure derived from an aliphatic hydroxycarboxylic acid; and wherein, when a modification rate (mass %) of the vinyl-modified crystalline polyester resin having a molecular weight of at least $1\times10^{3.5}$ and less than $1\times10^{\{3.5+(A90-3.5)/4\}}$ is defined as $X_1$;

a modification rate (mass %) of the vinyl-modified crystalline polyester resin having a molecular weight of at least $1\times10^{\{3.5+(A90-3.5)/4\}}$ and less than $1\times10^{\{3.5+(A90-3.5)\times2/4\}}$ is defined as $X_2$;

a modification rate (mass %) of the vinyl-modified crystalline polyester resin having a molecular weight of at least $1\times10^{\{3.5+(A90-3.5)\times2/4\}}$ and less than $1\times10^{\{3.5+(A90-3.5)\times3/4\}}$ is defined as $X_3$; and;

a modification rate (mass %) of the vinyl-modified crystalline polyester resin having a molecular weight of at least $1\times10^{\{3.5+(A90-3.5)\times3/4\}}$ and $1\times10^{(A90)}$ or less is defined as $X_4$; where, $1\times10^{(A90)}$ represents a molecular weight at an integrated value 90% of the integral molecular weight distribution curve, $X_1$, X2, X3 and X4 satisfies the following formula (1):

$$X_1<X_2<X_3<X_4 \quad (1).$$

2. The toner according to claim 1, wherein the vinyl-modified crystalline polyester resin is a block polymer including a crystalline polyester segment and a vinyl polymer segment.

3. The toner according to claim 1, wherein a mass ratio (modification rate) of the vinyl polymer segment in the vinyl-modified crystalline polyester resin is 10 mass % or more and 60 mass % or less.

4. The toner according to claim 1, wherein the weight average molecular weight (Mw) of the vinyl polymer segment in the vinyl-modified crystalline polyester resin is 3000 or more and 20000 or less.

5. The toner according to claim 1, wherein the weight average molecular weight (Mw) of the vinyl-modified crystalline polyester resin is 10000 or more and 100000 or less.

6. The toner according to claim 1, wherein a melting point of the vinyl-modified crystalline polyester resin is 55° C. or more and 85° C. or less.

7. The toner according to claim 1, wherein a content of the vinyl-modified crystalline polyester resin is 1 mass % or more and 35 mass % or less with respect to the binder resin.

8. The toner according to claim 1, wherein the crystalline polyester segment of the vinyl-modified crystalline polyester resin has the structure of i).

* * * * *